US005160473A

United States Patent [19]

Bontrager

[11] Patent Number: 5,160,473

[45] Date of Patent: Nov. 3, 1992

[54] METHOD OF MANUFACTURING FOAM PACKAGING FRAME BLANK

[75] Inventor: Rick L. Bontrager, Ripon, Calif.

[73] Assignee: Great Western Foam Products Corporation, Hayward, Calif.

[21] Appl. No.: 701,764

[22] Filed: May 17, 1991

Related U.S. Application Data

[62] Division of Ser. No. 556,320, Jul. 20, 1990, Pat. No. 5,024,328.

[51] Int. Cl.[5] ..... B29C 53/00

[52] U.S. Cl. ..... 264/138; 264/154; 264/321; 206/523

[58] Field of Search ..... 206/523, 586; 264/138, 264/154, 155, 321

[56] References Cited

U.S. PATENT DOCUMENTS

| | | | |
|---|---|---|---|
| 2,860,555 | 11/1958 | Williamson | 83/682 |
| 3,346,221 | 10/1967 | Farmer | 264/321 |
| 3,368,441 | 2/1968 | Piazze | 83/682 |
| 3,447,199 | 6/1969 | Trimble | 264/321 |
| 3,475,526 | 10/1969 | Seto | 264/321 |
| 3,580,469 | 5/1971 | Reese | 206/523 |
| 3,832,083 | 8/1974 | Dockery et al. | 83/682 |
| 3,839,525 | 10/1974 | Doll | 264/154 |
| 3,939,236 | 2/1976 | Hahn | 264/321 |
| 3,985,600 | 10/1976 | Blais | 264/156 |
| 4,106,597 | 8/1978 | Shook et al. | 206/523 |
| 4,242,072 | 12/1980 | Enicks | 264/321 |
| 4,242,074 | 12/1980 | Lake | 264/321 |
| 4,869,369 | 9/1989 | Turngren | 206/523 |

*Primary Examiner*—Willard Hoag
*Attorney, Agent, or Firm*—Harlan P. Huebner

[57] ABSTRACT

A method for making a packaging frame to protect parts formed from a blank including interior cuts and minimal cutouts, said blank being operable shift to and form a single piece frame having an exterior quadrilateral to interfit within a packing container and conform to the interior thereof and having an interior perimeter to accommodate the reception of a part for shipment.

3 Claims, 2 Drawing Sheets

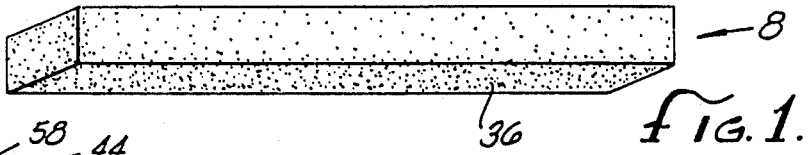
FIG. 1.
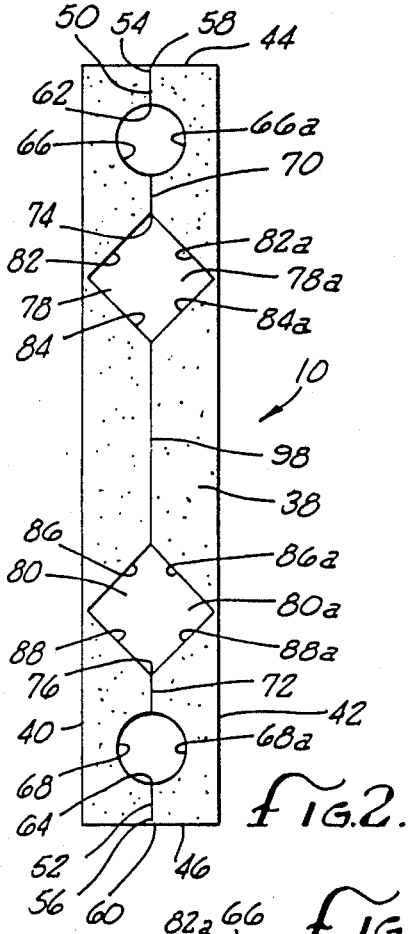
FIG. 2.
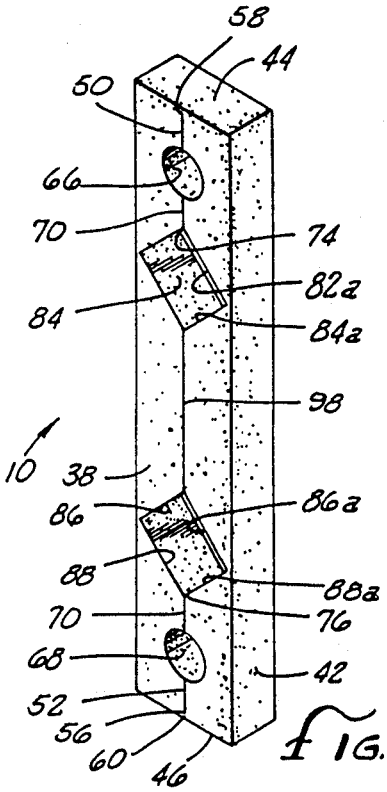
FIG. 3.
FIG. 4.
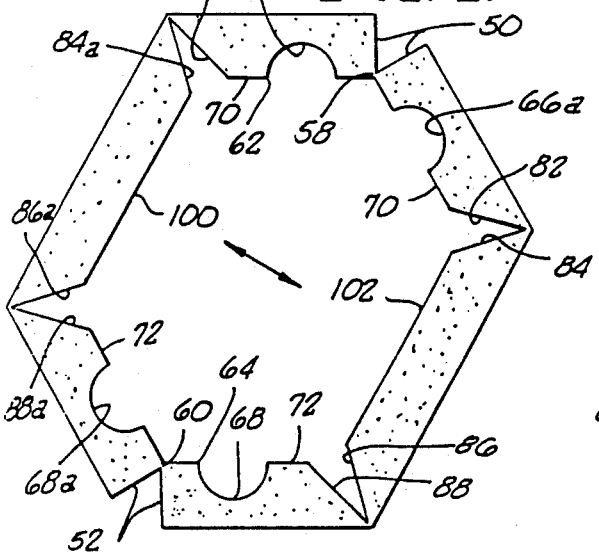
FIG. 5.
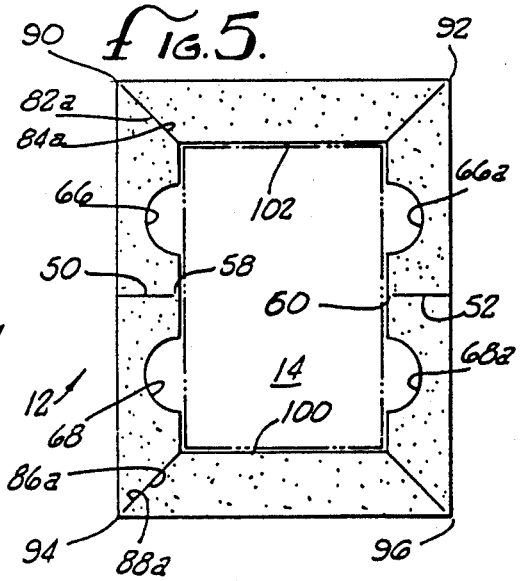

METHOD OF MANUFACTURING FOAM PACKAGING FRAME BLANK

This is a division of application Ser. No. 07/556,320 filed Jul. 20, 1990, now U.S. Pat. No. 5,024,328 issued Jun. 18, 1991.

BACKGROUND OF THE INVENTION

1. Field of the Invention

This invention relates to a foam blank which is cut and opened to form a packing frame adapted to encircle an item for packaging and shipment such as a fragile electronic part.

2. Description of the Prior Art

Heretofore in the packaging of fragile items, such as computer parts, padding has been placed in a container and the item to be shipped is wrapped in insulation such as bubble wrap or other plastic and further surrounded by more top and side padding.

Subsequent to that, plastic frames as made from flexible urethane have been cut by any manner of means to the exact exterior and interior configuration to fit within the carton and to surround the item to be shipped. Such frames have been made from a blank piece of foam corresponding to the exterior demension thereof and to the interior demension of the container. The necessary interior shape (to conform to the item to be shipped) is either die cut by a punch or cut by a hot wire.

In either of the above events the material removed from the blank is wasted material that is discarded. Such a process is expensive due to the wasting of the cut material and the need for a large piece of foam to form the frame.

SUMMARY OF THE INVENTION

It is the object of the present invention to provide a foam blank such as from flexible foam that preferably has a width representing twice the width of one side of a desired frame formed therefrom to package a specific fragile item.

It is another object of the present invention to provide a foam blank such as from flexible foam that preferably has a length equal to one half the circumference of the frame formed therefrom.

Another object of the present invention is to make predetermined cuts and cutouts within a foam blank whereby the blank may be pulled apart and folded or hinged along said cutouts and said cuts making a unitary frame adapted to receive a fragile item therein.

A still further object of the present invention is to provide a foam blank such as from flexible foam that may have internal cuts and cutouts within the blank that vary to change the internal configuration of the frame formed from said blank.

Another object of the present invention is to provide a foam blank such as flexible urethane which may be die cut in one single operation within the exterior circumference to provide cuts and cutoffs for folding said blank to a foam frame.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which:

FIG. 1 is a foam block used to form a blank for a protective frame to encircle a fragile item for packaging and shipping;

FIG. 2 is a foam blank formed from the block which has been cut through a thickness within the perimeter of the blank with various cuts and cutouts;

FIG. 3 is a perspective view of the blank of FIG. 2;

FIG. 4 is a top plan view of the blank of FIGS. 2 and 3 wherein it is being pulled apart and opened to form a frame;

FIG. 5 is a top plan view of the blank wherein it is fully pulled apart forming a finished frame that is adapted to fit within a container and receive a fragile item having a generally complementary exterior perimeter corresponding with the interior of the frame.

DETAILED DESCRIPTION OF THE PREFERRED EMBODIMENT

In FIG. 1 there is illustrated a block generally designated 8 which is to be formed into a blank designated 10. It is preferably formed of polyurethane foam. It has been found that a foam with a 1.9 density and an IFD of 100 is quite acceptable for making a frame designated 12 for use in packaging of a part designated 14 such as an electronic or computer part that is particularly fragile.

Figure 6:
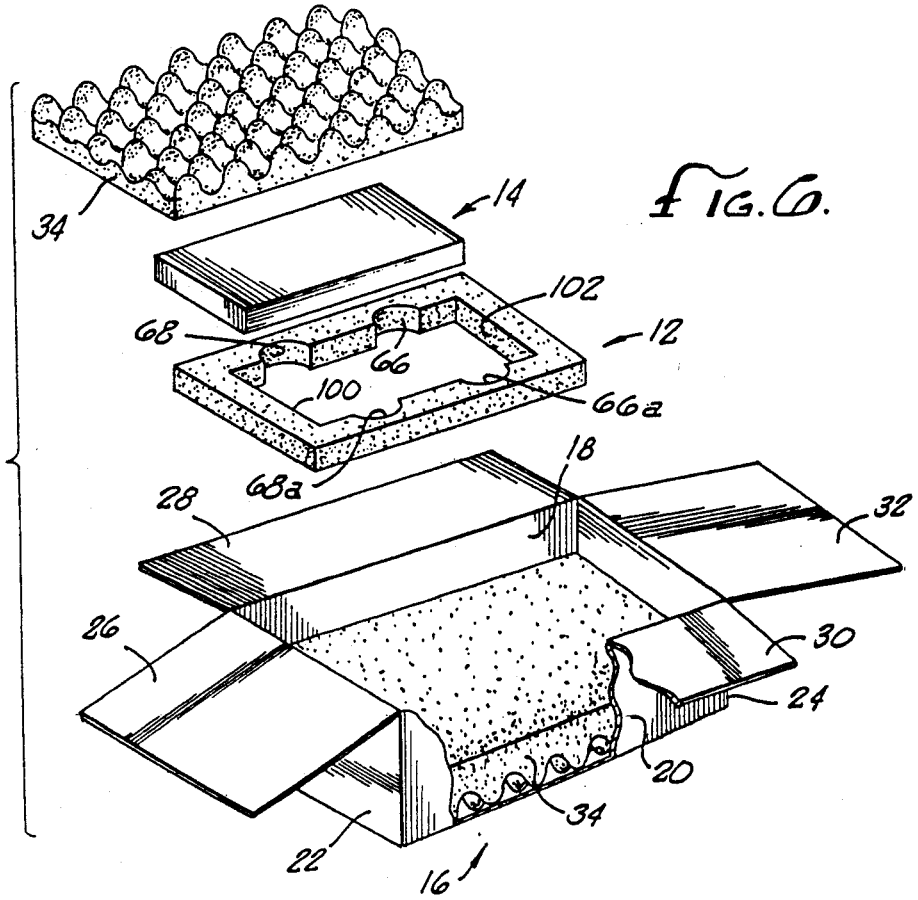
FIG. 6 is an exploded view of a container, the frame of the present invention and other insulation material illustrating how a fragile item may be packaged therein.

As can be seen from the drawings the blank 10 with appropriate cuts and cutouts to be described may be opened to a position in FIG. 5 forming the frame 12. A use of the frame 14 can be seen in FIG. 6 wherein there is a conventional packing box or container 16 of cardboard or the like having sides 18 and 20, ends 22 and 24 and the normal top flaps 26–32. Fitted within the box 16 may be a foam packing cushion 34. The frame 12 may be inserted within the box 16 on the cushion 34. As can be seen, the exterior perimeter of the frame 12 will conform to the interior perimeter dimensions of the box 16.

Next the part 14 is inserted within the frame 12 and additional packing material 34 may be placed on the frame 12 and part 14.

When the flaps 26–32 are closed and sealed, the package is ready for shipping wherein damage will be prevented to the fragile item or part 14.

Now returning to the blank 10, attention is directed to FIGS. 2 and 3. The foam blank 10, includes a bottom surface 36 and top surface 38. Also there are opposed sides 40 and 42 and opposed ends 44 and 46 with the surfaces 36 and 38 extending therebetween. In the drawings the blank 10 is elongated, but the size may vary depending upon the final shape and perimeter needed to protect the fragile part 14 as well as the interior of the container 16.

As shown in FIGS. 2 and 3, the blank 10 is provided with various cuts and cutouts. The cuts and cutouts of the FIGS. 2 and 3 blanks will produce a frame 12 being longer than its width with four finger holes to help in removal of the part 14, see FIG. 5.

The cuts and cutouts may be done separately or by one die cutter.

Equidistant the sides 40 and 42 there are provided central adjacent end cuts 50 and 52. The cuts 50 and 52, which extend through the blank 10, from surface 38 through surface 36, terminate in ends 54 and 56. These ends as can be seen, stop short of the blank ends 44 and 46 so there is actually a hinge 58 and 60 therebetween.

At ends 62 and 64 of the cuts 50 and 52, there is provided at least one cutout 66 and 68. However, in the preferred embodiment there is also opposed cutouts 66*a* and 68*a*. These cuts 66 and 68 actually will form figure holes, see FIGS. 5 and 6, that open into the area for storing the part when the blank is opened up to its usable position of FIGS. 5 and 6.

The blank 10 is then provided with intermediate central cuts 70 and 72 extending through the blank. The length of the cuts 70 and 72 help to determine the length of the end frame 12.

At the ends 74 and 76 there are provided opposed V shaped cutouts 78 and 80, extending through the blank 10 and having side walls 82 and 84 and 82*a* and 84*a* respectively and 86 and 88 and 86*a* and 88*a* respectively. The angles of the side walls, in the case of the frame 12 in the drawings, are 45° so that then the blank 10 is opened, the side walls 82 and 84 meet, 82*a* and 84*a* meet, 86 and 88 meet and 86*a* and 88*a* meet forming miter corners as in FIG. 5 so there is a right angle frame. The side walls form the corners.

The side wall cuts of the V shaped cutouts 78 and 80 do not extend to the sides 38 and 40 respectively of the blank 10, but terminate short thereof so there are hinged portions which actually form the four corners 90, 92, 94 and 96 of the frame 12.

Extending between the V shaped cutouts 78, 80, 86 and 88 is a central cut 98 which produces two edges 100 and 102. The cut 98 also extends through the blank 10. The length of the cut 98 is dictated by the desired width of the frame 12.

Thus with the cuts and cutouts made in the blank 10 so that it looks like FIGS. 2 and 3, there is no separation of sections because all the cuts or cutouts that extend toward the sides 18 and 20 and ends 22 and 24 of the blank terminate in hinge sections The frame 12 is a one piece structure with no wasting of large pieces of material cut out of a block that corresponds to the inside of the container 16.

Once the blank 10 is prepared as in FIG. 3, the respective sides may be pulled away from each other, as shown in FIG. 4 and the hinging occurs so that the frame 12 is formed with its 45° miter corners and an internal perimeter complementary to the part 14.

Figure 8:
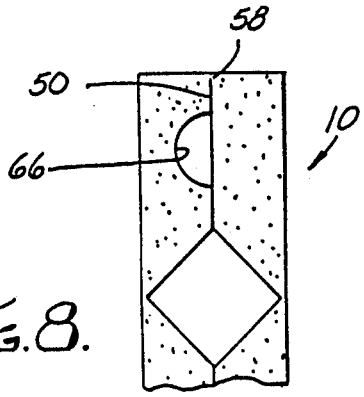
FIG. 8 is a modified partial foam blank with only one finger opening cutout on a side.

FIG. 8 illustrates a portion of a blank 10 with a single finger hole 66 cut only on one side of the cut 50 instead of two in the preferred embodiment.

Figure 7:
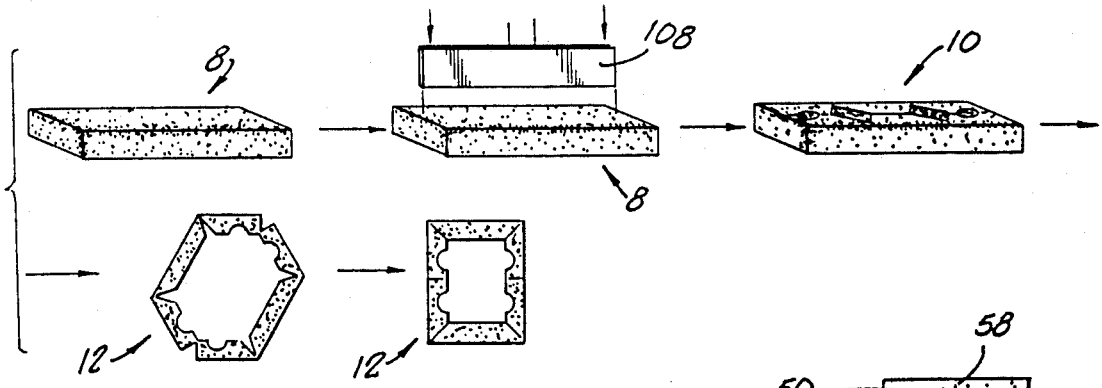
FIG. 7 is a schematic figure illustrating one way to form the foam blank into a protective frame to encircle a fragile item for packaging and shipping.

FIG. 7 is a schematic showing a block 8 passing beneath a die 108 that includes cutting blades which, when pressed downward into the block 8, will produce the blank 10 with the cuts and cutouts. At that point the blank 10 is pulled apart and the frame 12 is formed.

As stated earlier, when the frame 12 is opened, it may be placed in the container or box 16 to receive the part 14.

While a rectangular frame 12 has been illustrated and described, it must be recognized that any dimensioned quadrilateral may be formed from a single generally elongated block of foam. In addition, by varying the angles on the sides of the V cutouts 78 and the number thereof, additional multisided frames 12 may be created for specific purposes. However, in each instance there is no waste of foam because the frame 12 is formable by the blank 10 due to the various cuts and cutouts.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. The method of forming a single piece connected polyurethane foam packing frame from a blank, said frame to receive a part therein for protection against damage when oriented in a shipping container including the steps of:

preparing a cutting die to provide an elongated central centered cut along the length of said block and cutouts within said block projecting outwardly of said elongated cut;

moving a block of polyurethane wherein the length of said block is greater then said width and the thickness corresponds to at least that of said part beneath said die;

pressing said die through said block forming a cut blank wherein said elongated central cut extending along the greater length terminates within the perimeter of said block and two pair of V shaped corner cutouts are formed on each side of said central cut yet terminating inwardly of the exterior of said block;

opening said block to form said packing frame, said frame forming a quadrilateral with said V shaped corner cutout forming miter corners and an interior configuration formed by said elongated central cut complementary with the exterior configuration of said part.

2. The method of claim 1 wherein said cuts and cutouts include:

forming an elongated cutting blade in said die, and forming two pair of opposed V shaped cutout blades in said die on each side of said elongated cutting blade.

3. The method of claim 2 wherein an additional cutout is provided by:

forming at least one finger semi-circular cutout blade projecting outwardly from said elongated cutting blade, whereby when said block is cut and said blank is formed said frame will include a finger hole extending inwardly from the interior configuration to gain access to remove said part.

* * * * *